US006568966B1

(12) United States Patent
Korsunsky et al.

(10) Patent No.: US 6,568,966 B1
(45) Date of Patent: May 27, 2003

(54) STACKED MODULAR JACK ASSEMBLY HAVING IMPROVED MAGNETIC MODULE

(75) Inventors: Iosif R. Korsunsky, Harrisburg, PA (US); Kevin E. Walker, Hershey, PA (US); James H. Hyland, Hummelstown, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/279,152

(22) Filed: Oct. 23, 2002

Related U.S. Application Data

(63) Continuation-in-part of application No. 10/037,061, filed on Nov. 8, 2001, now Pat. No. 6,506,080.

(51) Int. Cl.[7] ..... H01R 24/00

(52) U.S. Cl. ..... 439/676; 439/76; 439/83; 439/620; 439/941

(58) Field of Search ..... 439/620, 676, 439/941, 76, 83

(56) References Cited

U.S. PATENT DOCUMENTS 5,069,641 A 12/1991 Sakamoto et al.
5,587,884 A 12/1996 Raman
5,647,767 A 7/1997 Scheer et al.
5,687,233 A 11/1997 Loudermilk et al.
6,010,367 A * 1/2000 Wu ..... 439/620
6,227,911 B1 * 5/2001 Boutros et al. ..... 439/620
6,302,741 B1 * 10/2001 Fasold et al. ..... 439/620
6,319,064 B1 * 11/2001 Belopolsky et al. ..... 439/620

OTHER PUBLICATIONS

MagJack Family of Modular Jacks with Integrated Magnetics, http://www.Stewartconnector.com/pdfs/magjkfy.pdf.

* cited by examiner

*Primary Examiner*—Tho D. Ta
*Assistant Examiner*—Truc Nguyen
(74) *Attorney, Agent, or Firm*—Wei Te Chung

(57) ABSTRACT

An electrical connector assembly (1) includes an insulating housing (2) and an electrical subassembly (3) disposed within the housing. The electrical subassembly includes first and second contact array assemblies (32, 34) and a pair of magnetic modules (300, 300') each having a container (302, 302') for retaining magnetic coils (31, 31') therein, a plurality of upper and lower pins (304, 304', 306, 306') respectively disposed on upper and lower portions of the container and being coupled to the magnetic coils, some of the upper pins are electrically connected to the corresponding contact array assembly, and the lower pins are electrically connected to a mother board.

1 Claim, 11 Drawing Sheets

STACKED MODULAR JACK ASSEMBLY HAVING IMPROVED MAGNETIC MODULE

CROSS-REFERENCE TO RELATED APPLICATIONS

This patent application is a continuation-in-part of U.S. patent application Ser. No. 10/037,061, filed on Nov. 8, 2001 now U.S. Pat. No. 6,506,080; and is related to a U.S. patent application Ser. No. 10/033,663, filed on Dec. 26, 2001, invented by the same inventors as this patent application; Ser. No. 10/247,460, entitled "STACKED MODULAR JACK ASSEMBLY HAVING BUILT-IN CIRCUIT BOARDS", invented by the same inventors as this patent application; Ser. No. 10/256,554, entitled "HIGH FREQUENCY MODULAR JACK CONNECTOR", invented by the same inventors as this patent application; Ser. No. 10/242,002, entitled "STACKED MODULAR JACK ASSEMBLY HAVING HIGHLY MODULARIZED ELECTRONIC COMPONENTS", invented by the same inventors as this patent application; Ser. No. 10/232,879, entitled "MODULAR JACK ASSEMBLY HAVING IMPROVED POSITIONING MEANS", invented by the same inventors as this patent application; and Ser. No. 10/242,024, entitled "STACKED MODULAR JACK ASSEMBLY HAVING IMPROVED ELECTRIC CAPABILITY", invented by the same inventors as this patent application, and all assigned to the common assignee with this application. Copies of the specifications are hereto attached for reference.

BACKGROUND OF THE INVENTION

1. Field of the Invention

The present invention relates to an electrical connector assembly, and particularly to a stacked modular jack assembly for LAN (Local Area Network) application and having improved magnetic module for reducing and suppressing noise.

2. Description of Related Art

It is quite common to use modular jacks for the data transmission in high speed applications such as IEEE 802.3 10Base-T or 100Base-T local area networks. A common problem to these high speed modular jacks is their tendency to emit high frequency radiation. There is also a need to provide means for suppressing undesirable noise.

Noise suppressors or signal conditioning components, such as common mode choke coils, are known in the art. The noise suppressors are mounted on a mother board on which the modular jack is seated. The noise suppressors are electrically connected with the modular jack by wires on the mother board. However, such signal conditioning components consume board space, which could otherwise be used for other circuitry. Furthermore, since the signal conditioning components are distant from the modular jack, the signal traces required to route the signals from the modular jack to the signal conditioning components degrade the signal integrity somewhat, thereby lowering the signal-to-noise ratio.

U.S. Pat. No. 5,069,641, issued to Sakanmoto et al on Dec. 3, 1991, discloses a modular jack assembly comprising a dielectric housing and a printed circuit board (PCB) disposed within the housing. The PCB contains noise suppressors. A common mode choke coil and a three-terminal capacitor arrangement are used as a typical noise suppressor. The PCB is fitted with contactors and terminals respectively for contacting with a modular plug and mounting the modular jack assembly on a mother board. The contactors and the terminals are electrically connected with the noise suppressors by wires on the PCB. For saving space, the PCB is disposed perpendicularly to a bottom surface of the housing, while such arrangement is unstable.

U.S. Pat. Nos. 5,587,884 and 5,647,767, respectively issued to Raman on Dec. 24, 1996 and Scheer et al. on Jul. 15, 1997, and both assigned to The Whitaker Corporation, each disclose a modular jack assembly comprising an insulating housing and an insert subassembly received in the housing. The insert subassembly includes front and rear insert members. The front insert member has contact terminals encapsulated therein for mating with a modular plug. The rear insert member has a printed circuit board and leads encapsulated therein. The printed circuit board contains signal conditioning components such as common mode choke coils. The leads extend downwardly for electrically connecting to external circuits, such as a mother board. The terminals and the leads are soldered to the printed circuit board and electrically connected with the signal conditioning components by wires on the printed circuit board. Since the noise induced in the contact terminals of the modular jack assembly have similar spectral content, adequate cancellation of noise can be achieved by differential circuits. However, high speed applications such as 100 mbps local area networks require additional more sophisticated signal conditioning circuitry.

U.S. Pat. No. 5,687,233, issued to Loudermilk et al on Nov. 11, 1997, assigned to Maxconn Incorporated, discloses a modular jack assembly addressing the problem encountered in the '884 and '767 patents. The modular jack assembly employs a number of signal conditioning components such as capacitors and magnetic coils to provide sufficient conditioning of data transmission. Signal pins are divided into a contact pin array and a mounting pin array. The two pin arrays are electrically coupled through an internal printed circuit board which has the capacitors and magnetic coils thereon. However, because the capacitors and magnetic coils are all mounted on the same printed circuit board, mutual interference between the signal conditioning components may also be a problem.

Recently, in order to save valuable real estate of mother boards in electronic devices, modular jacks are developed to be arranged in a stacked manner. Setwart, headquartered in Glen Rock, Pa., posted an article, entitled "MagJack Family of Modular Jacks with Integrated Magnetics" on the Internet website address, http://www.stewartconnector.com/pdfs/magjkfy.pdf. A modular jack introduced in this article has upper and lower ports. Two magnetic components needed for the upper and lower ports are housed within a jack body for protecting signals from internally and externally generated noise. However, because the two magnetic components are directly mounted in the jack body, crosstalk or EMI (Electromagnetic Interference) between the two magnetic components may become a serious problem.

Hence, a stacked jack assembly having improved magnetic module is required to overcome the disadvantages of the prior art.

SUMMARY OF THE INVENTION

It is an object of the present invention to provide an electrical connector assembly having improved magnetic module for providing sufficient electrical function.

It is another object of the present invention to provide a stacked modular jack assembly having improved magnetic module for easy assembly.

In order to achieve the objects set forth, an electrical connector assembly in accordance with the present invention comprises an insulating housing and an electrical subassembly disposed within the housing. The electrical subassembly includes first and second contact array assemblies, a pair of magnetic modules each having a container for retaining a plurality of magnetic coils therein, a plurality of upper and lower pins respectively disposed on upper and lower portions of the container and being coupled to the magnetic coils, some of the upper pins are electrically connected to the corresponding contact array assembly, and the lower pins are electrically connected to a mother board.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
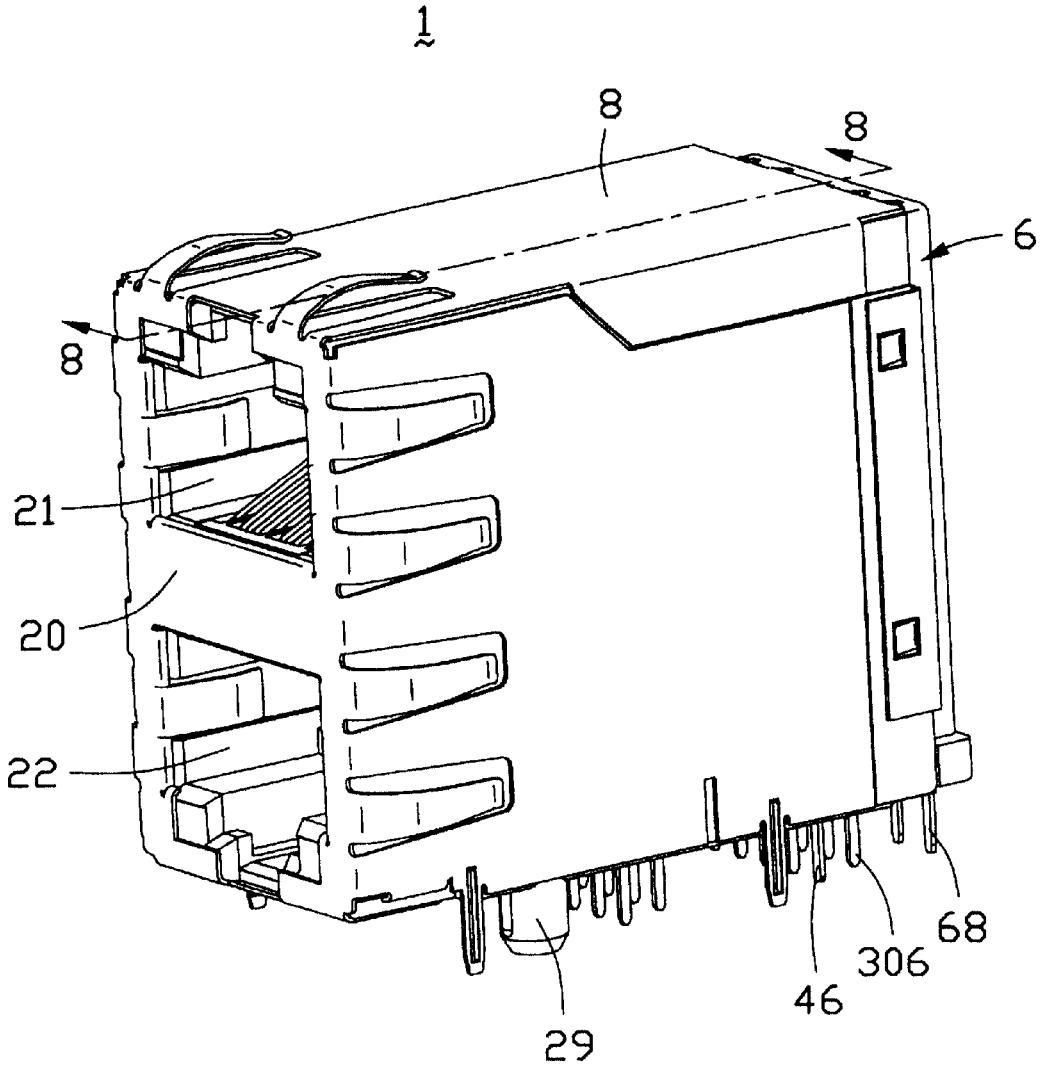
FIG. 1 is a perspective view of an electrical connector assembly in accordance with the present invention.
Figure 2:
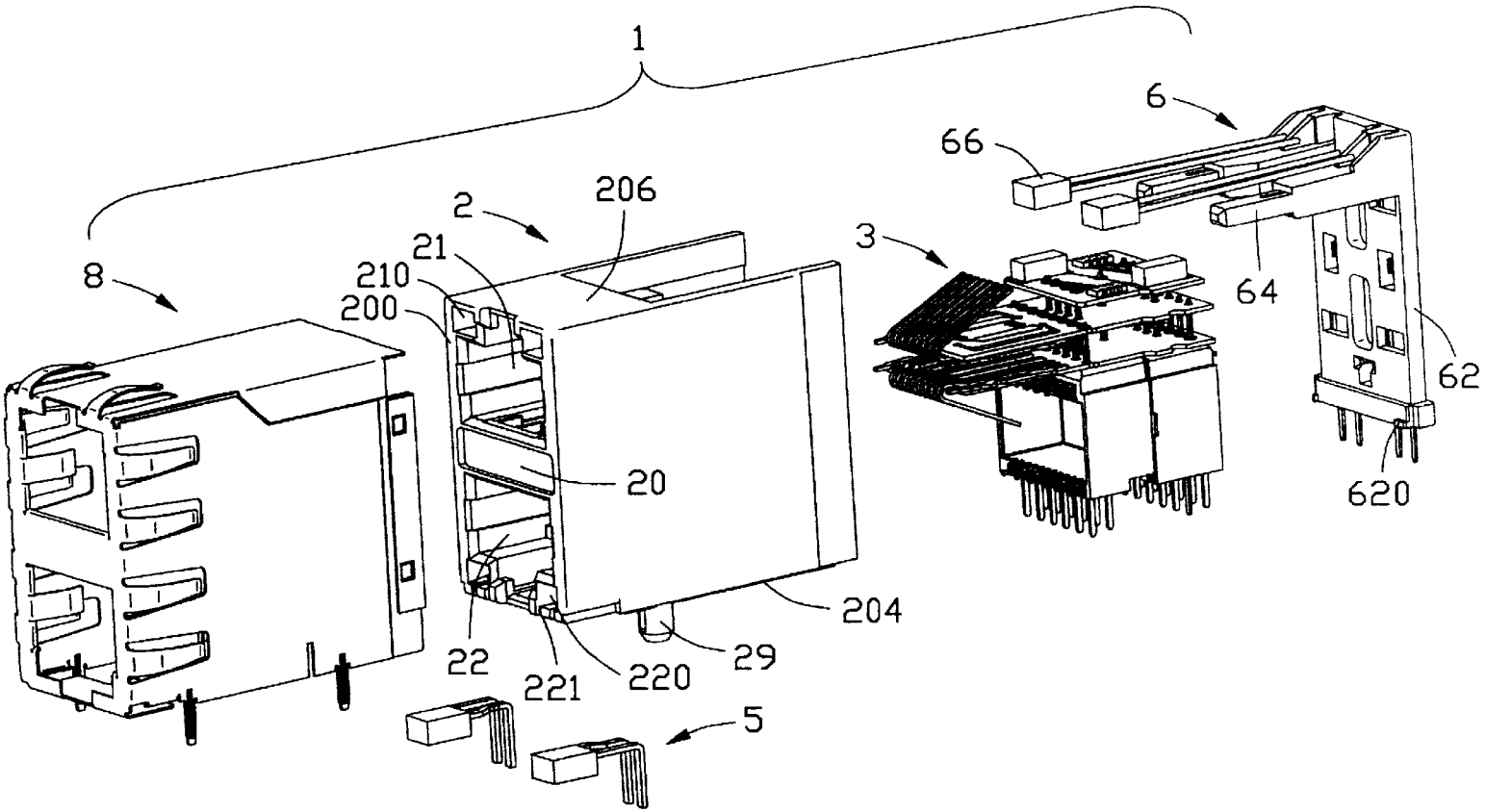
FIG. 2 is a front exploded view of the connector assembly of FIG. 1.

Referring to FIGS. 1 and 2, an electrical connector assembly 1 in accordance with the present invention comprises an insulating housing 2, an electrical subassembly 3 disposed within the insulating housing 2, an LED (Light-Emitting Diode) module 6 secured to the housing 2 for functioning as a visual indicator and a shell 8 optionally enclosing the housing 2 for EMI (Electromagnetic Interference) protection. In the preferred embodiment of the present invention, the electrical connector assembly 1 is a stacked LAN modular jack assembly for high speed signal transmission.

Figure 3:
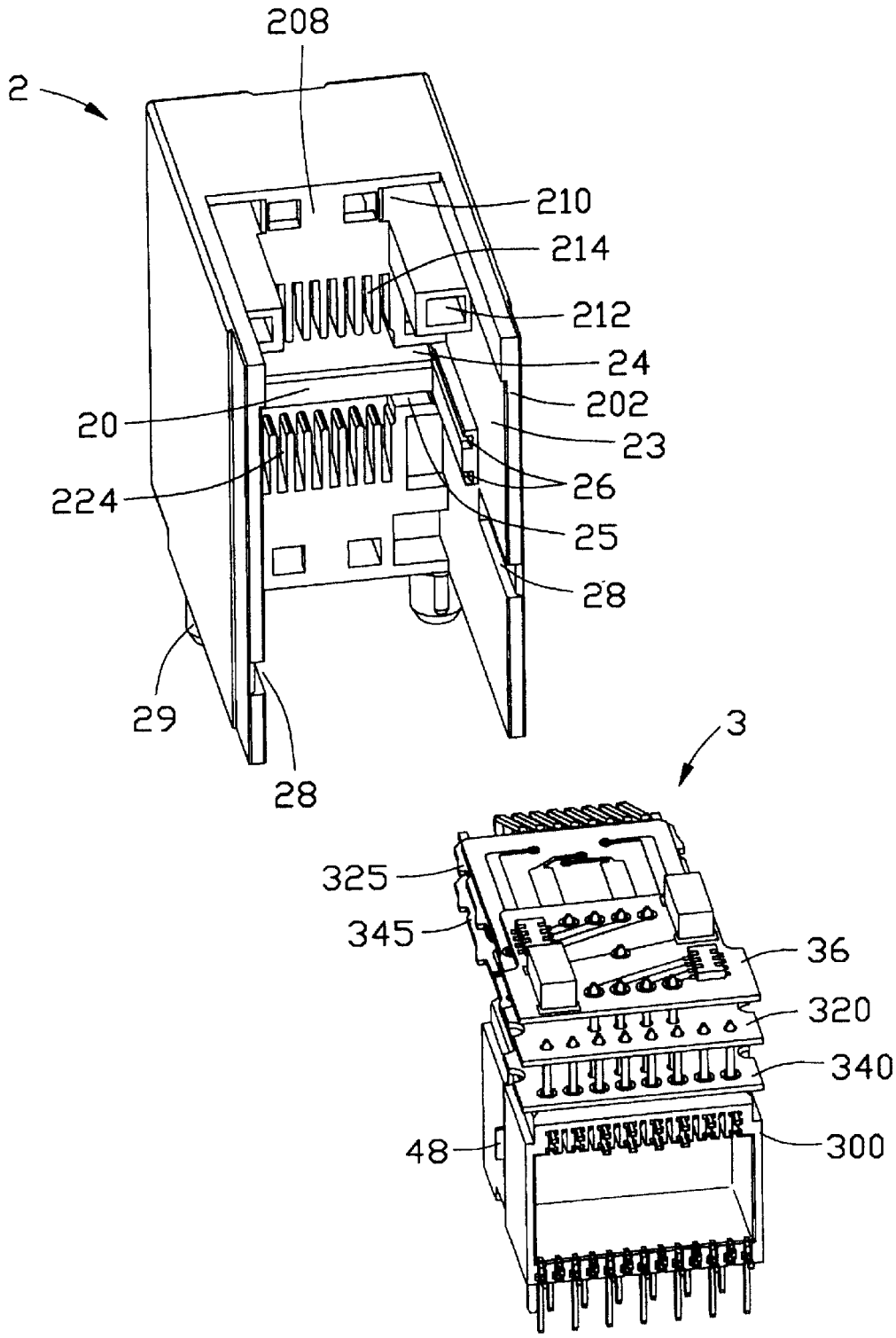
FIG. 3 shows an electrical subassembly of the present invention to be assembled into an insulating housing of FIG. 2, with a plurality of magnetic coils taken out therefrom.
Figure 4:
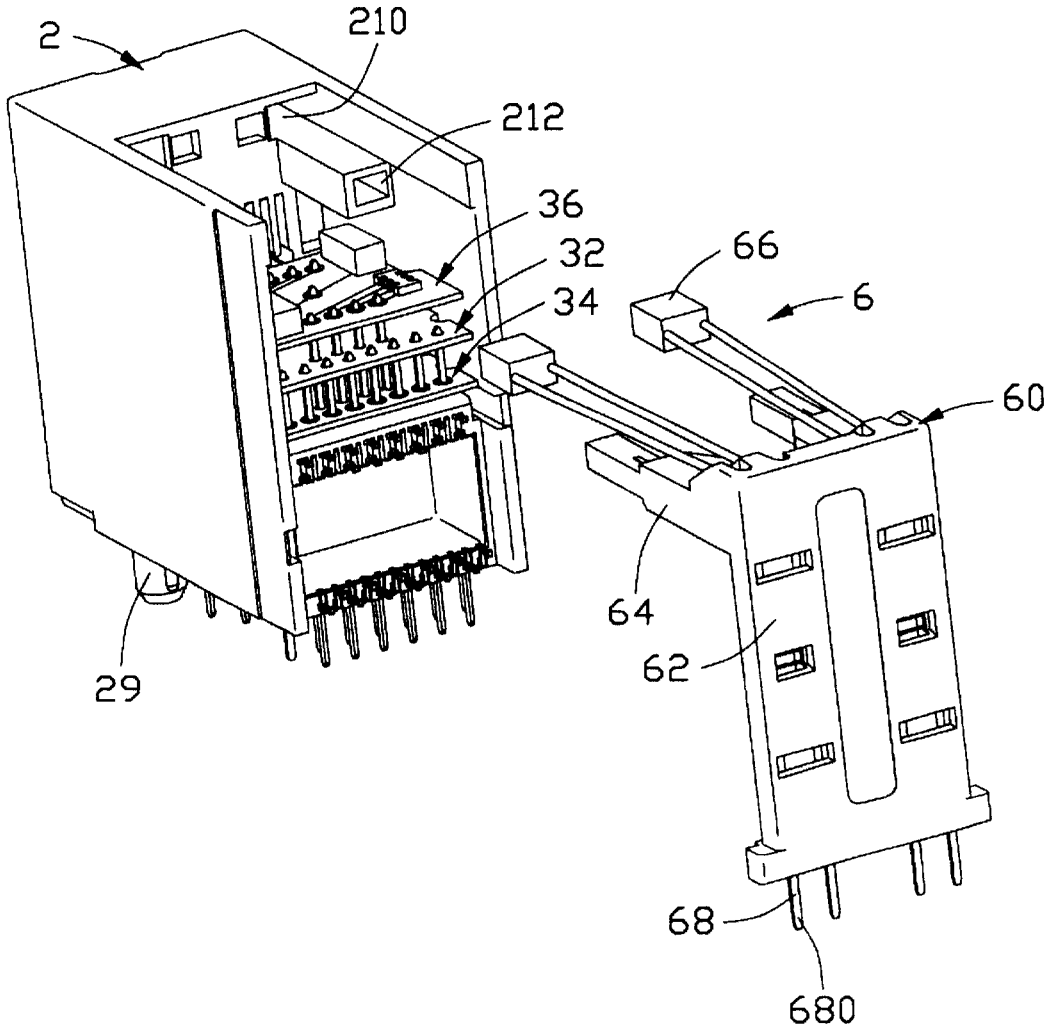
FIG. 4 is a partially assembled view of the connector assembly showing the electrical subassembly disposed within the insulating housing and an LED module to be assembled within the insulating housing.

Referring to FIGS. 3 and 4 in conjunction with FIGS. 1 and 2, the insulating housing 2 defines upper and lower receiving cavities 21, 22 in a front mating face 200 for receiving modular plugs (not shown), and a receiving space 23 in a rear face 202 communicating with the upper and lower receiving cavities 21, 22 through upper and lower channels 24, 25. The upper and lower receiving cavities 21, 22 share a partition wall 20 therebetween.

The housing 2 defines a pair of upper and lower holes 210, 220 located at four corners of the front mating face 200. Each lower hole 220, near a bottom mounting face 204, extends into the housing 2 for a predetermined length for receiving therein a standard LED 5. The LED 5 is inserted into the corresponding lower hole 220 with its right-angled legs fitted in slits 221 formed in the bottom mounting face 204. Each upper hole 210, near a top face 206, extends in the housing 2 from the front mating face 200 to the receiving space 23. The housing 2 defines a plurality of upper and lower slits 214, 224 extending through an intermediate wall 208 between the receiving cavities 21, 22 and the receiving space 23.

The housing 2 defines two pairs of grooves 26 extending in a back-to-front direction of the housing 2 beside the receiving space 23. The grooves 26 extend into the upper and lower receiving cavities 21, 22 through the upper and lower channels 24, 25. The housing 2 further defines a pair of recesses 28 beside the receiving space 23 and offsetting from each other in a vertical direction. In addition, the housing 2 has a pair of positioning posts 29 downwardly extending from the bottom mounting face 204 for being received in corresponding holes of a mother board (not shown) on which the electrical connector assembly 1 is to be mounted.

Figure 5A:
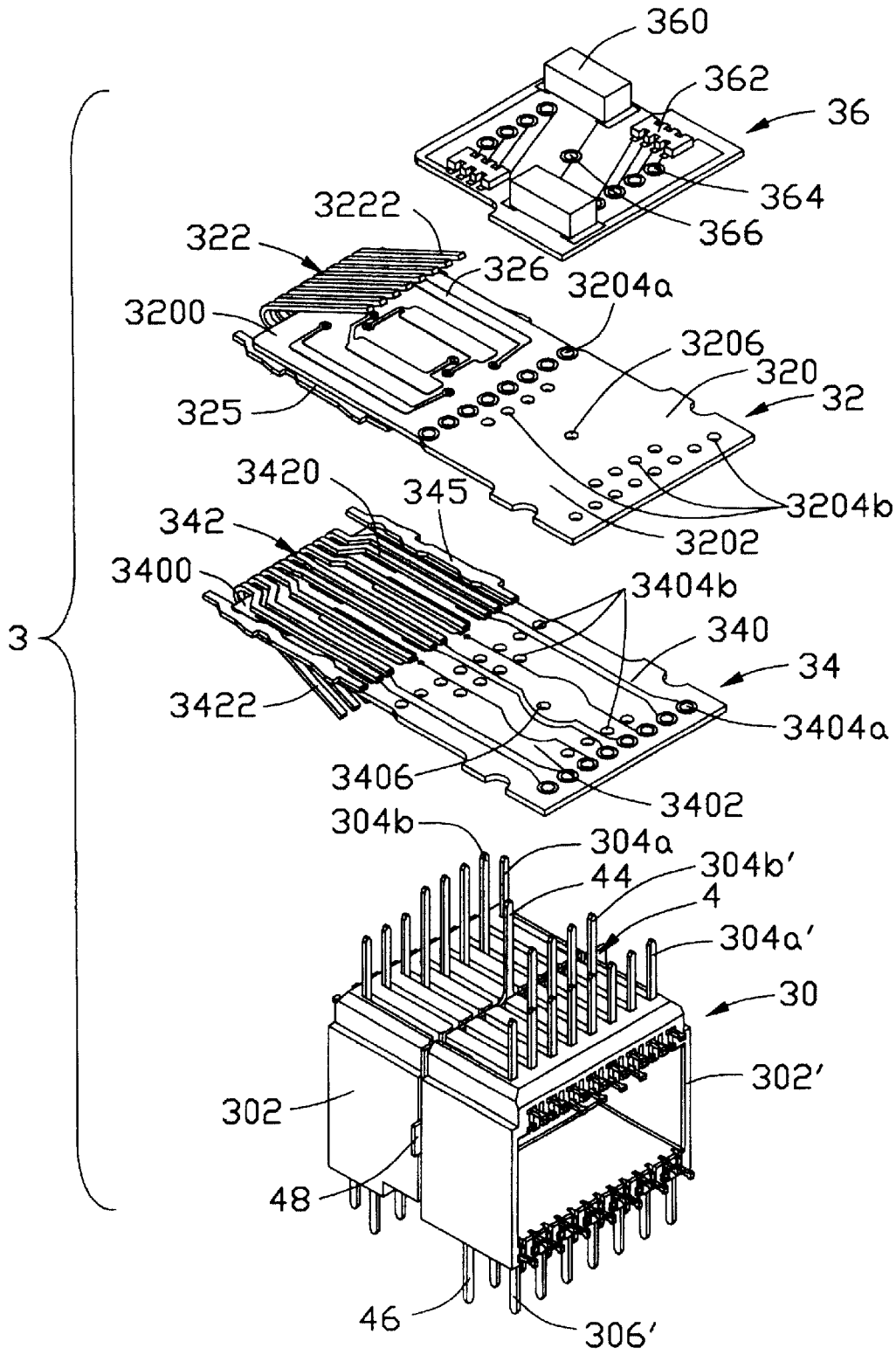
FIGS. 5*a* and 5*b* are exploded views of the electrical subassembly taken from different perspectives.
Figure 5B:
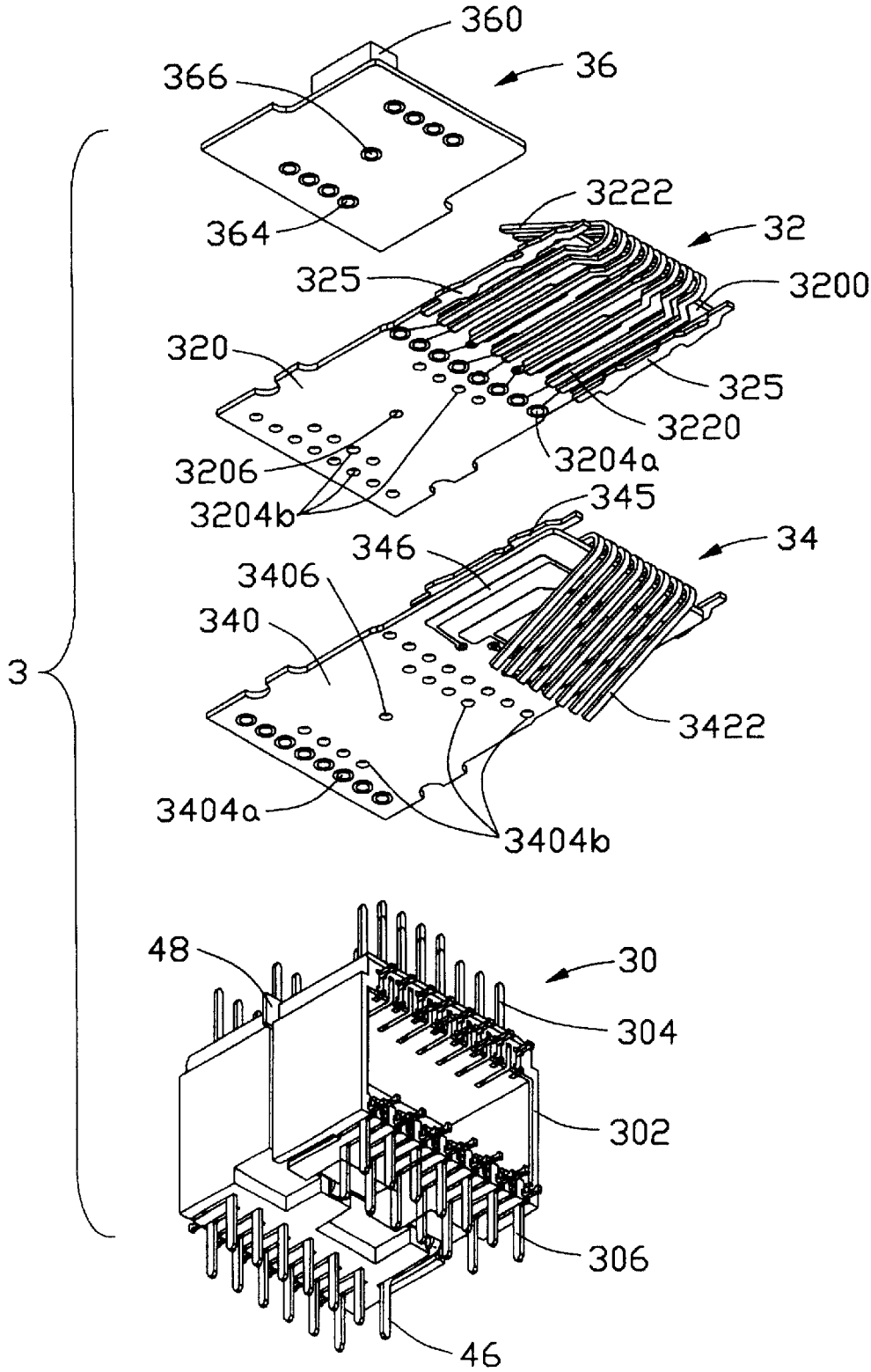
Figure 7A:
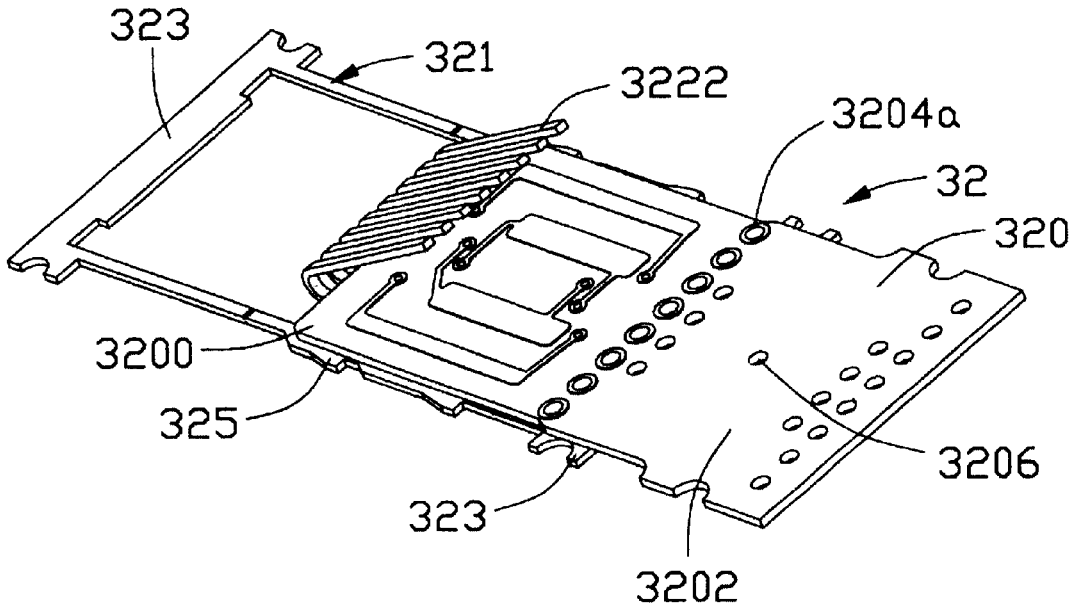
FIGS. 7*a* and 7*b* are perspective views of upper and lower contact array assemblies of the present invention with carriers not severed therefrom.
Figure 7B:
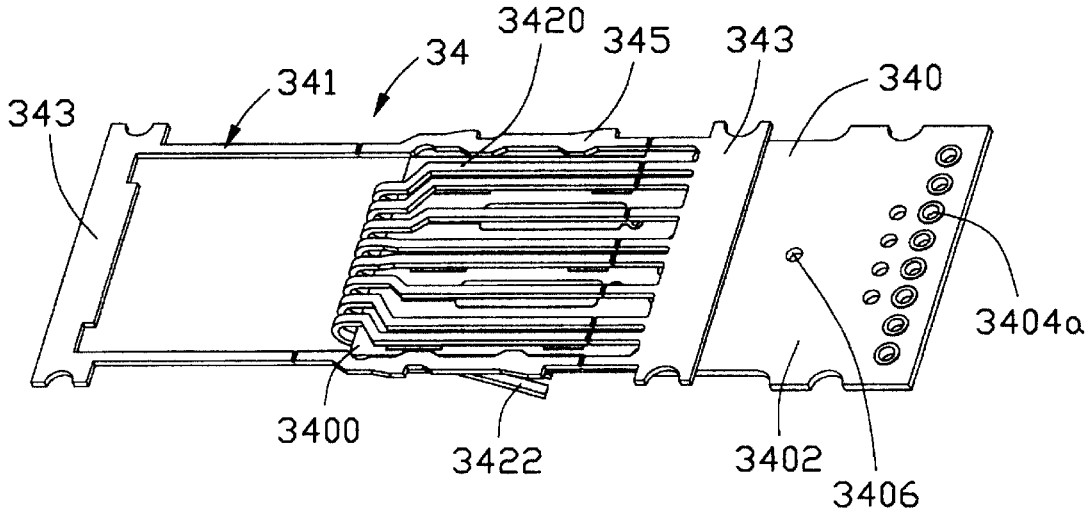

Referring to FIGS. 5*a* and 5*b* in conjunction with FIGS. 7*a* and 7*b*, the electrical subassembly 3 comprises a magnetic module assembly 30, upper and lower contact array assemblies 32, 34 positioned above the magnetic module assembly 30, and a third printed circuit board (PCB) 36 disposed above the upper contact array assembly 32.

The upper and lower contact array assemblies 32, 34 are near identical in structure. The upper and lower contact array assemblies 32, 34 have respective first and second printed circuit boards (PCBs) 320, 340 and respective first and second contact strips 321, 341 soldered on the first and second PCBs 320, 340. The first and second contact strips 321, 341 include respective first and second contacts 322, 342, respective first and second side conductors 325, 345 and respective first and second carriers 323, 343. The first and second side conductors 325, 345 are respectively soldered on opposite side edges of the first and second PCBs 320, 340 and extended beyond respective first and second front edges 3200, 3400. The first and second contacts 322, 342 have respective first and second tail portions 3220, 3420 respectively soldered on solder pads of the first and second PCBs 320, 340, and first and second mating portions 3222, 3422 extending from the respective first and second tail portions 3220, 3420 and being angled rearwardly to be respectively located above and below upper and lower faces of the PCBs 320, 340 on which conductive traces (not labeled) are formed. The solder pads to which the first and second contacts 322, 342 are soldered, and the conductive traces are so designed and arranged that they can affect cross-talk between the first contacts 322 and the second contacts 342, respectively. The related description of the solder pads and the conductive traces on the first and second PCBs 320, 340 are disclosed in patent application Ser. No. 10/037,061 filed on Nov. 8, 2001, and entitled "RJ MODULAR CONNECTOR HAVING SUBSTRATE HAVING CONDUCTIVE TRACE TO BALANCE ELECTRICAL COUPLINGS BETWEEN TERMINALS". The disclosures of the '061 application are wholly incorporated herein by reference.

The first and second PCBs 320, 340 define first and second plated through holes 3204*a*, 3404*a* and first and second clear through holes 3204*b*, 3404*b* at respective first and second rear portions 3202, 3402, and respective first and second clear apertures 3206, 3406 therein.

The third PCB 36 contains a plurality of signal conditioning components such as capacitors 360 and resistors 362 used for signal conditioning and termination. The third PCB 36 defines a plurality of third plated through holes 364 and a third plated aperture 366 therein. Capacitors 360 and resistors 362 are electrically connected to corresponding third plated through holes 364 via circuit traces (not labeled) on the third PCB 36.

Figure 6:
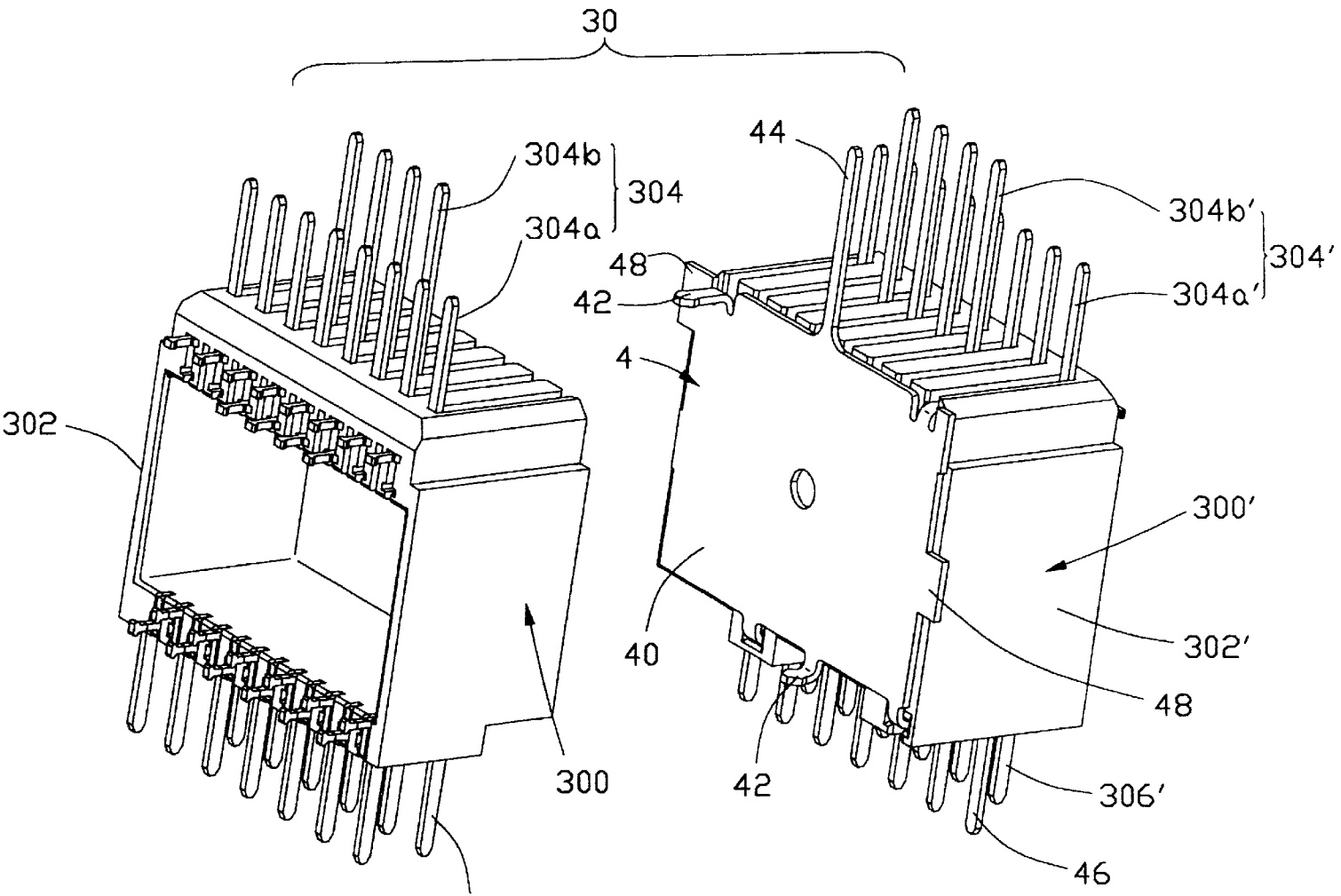
FIG. 6 is a partially exploded view of a magnetic module assembly of the present invention.
Figure 8:
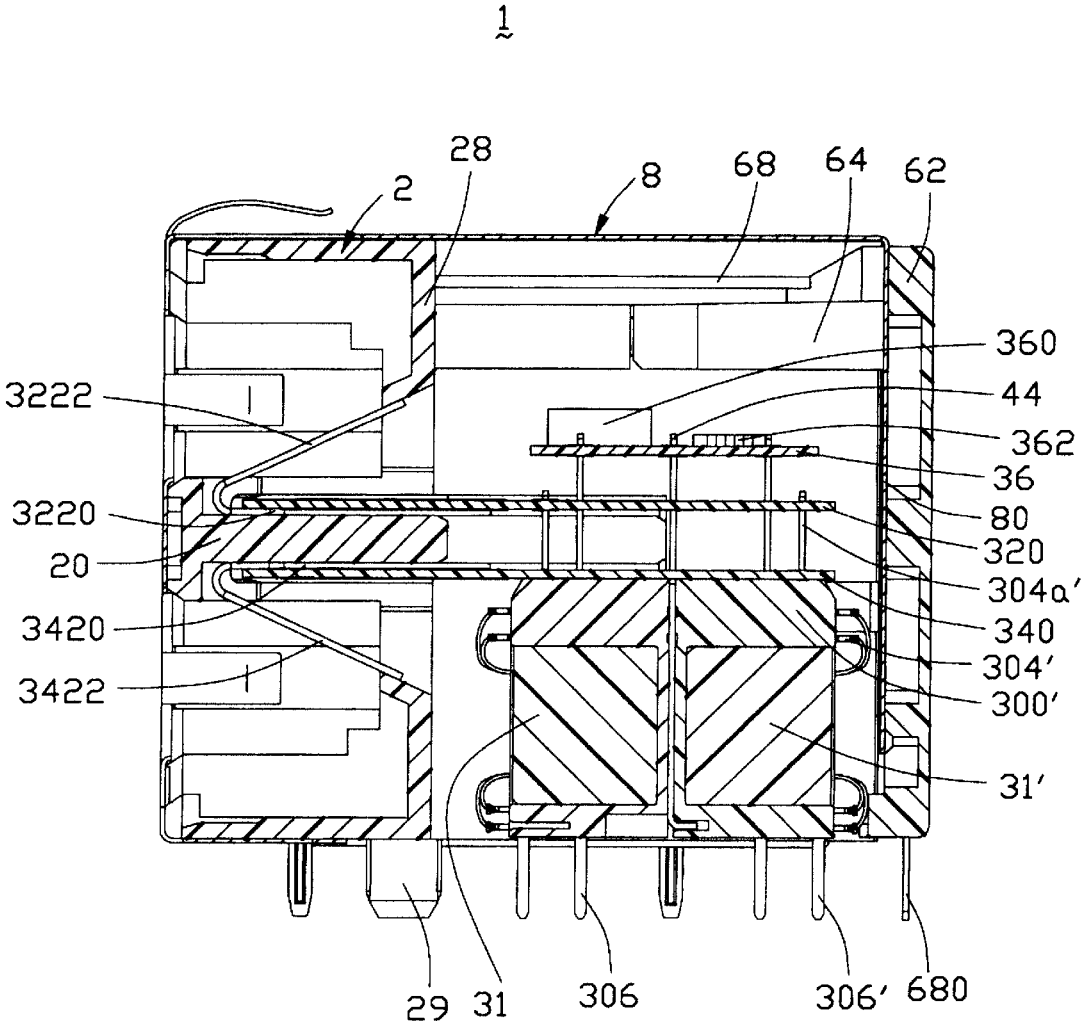
FIG. 8 is a cross-sectional view of the connector assembly taken along section line 8—8 of FIG. 1.

Referring to FIG. 6 the magnetic module assembly 30 includes front and rear magnetic modules 300, 300' located back to back, and a metal plate 4 disposed between the front and rear magnetic modules 300, 300'. The front and rear magnetic modules 300, 300' are near identical in structure. The front and rear magnetic modules 300, 300' each include a container 302 (302'), upper and lower pins 304, 306 (304', 306') each forming a right-angled structure and respectively disposed on upper and lower portions of the container 302 (302'), and a plurality of magnetic coils 31 (31') housed within the container 302 (302') and coupled to corresponding upper and lower pins 304, 306 (304', 306') via wires (not labeled), which is schematically shown in FIG. 8. The upper pins 304 (304') are divided into first and second pin arrays 304*a*, 304*b* (304*a'*, 304*b'*).

The metal plate 4 has a plane body 40 sandwiched between the front and rear magnetic modules 300, 300', and a plurality of tabs 42 extending forwardly and rearwardly from top and bottom edges of the plane body 40 and received in slots of the containers 302, 302' for joining the front and rear magnetic modules 300, 300' together. Upper and lower legs 44, 46 respectively extend upwardly and downwardly from top and bottom edges of the plane body 40. The lower leg 46 is bent to form a right-angled tail for being retained in a slit (not labeled) of the rear magnetic module 300'. The metal plate 4 further forms a pair of offsetting projections 48 respectively on side edges thereof. The metal plate 4 electrically shield and isolate the front and rear magnetic modules 300, 300' for reducing electrical interference thereof.

The first upper pin array 304*a'* of the rear magnetic module 300' is soldered to the second plated through holes 3404*a* of the second PCB 340 and electrically connected with the second contacts 342 by conductive wires (not labeled) on the second PCB 340. The first upper pin array 304*a* of the front magnetic module 300 first penetrates through the second clear through holes 3404*b* and then are soldered to the first plated through holes 3204*a* of the first PCB 320 and electrically connected with the first contacts 322 by conductive wires (not labeled) on the first PCB 320. The second upper pin arrays 304*b*, 304*b'* of the front and rear magnetic modules 300, 300' penetrate through the second and first clear through holes 3404*b*, 3204*b* to be soldered to the third plated through holes 364 of the third PCB 36. At the same time, the upper leg 44 of the metal plate 4 penetrates through the second and first clear apertures 3406, 3206 of the second and first PCBs 340, 320 to be soldered to the third plated aperture 366 of the third PCB 36.

It can be seen that when the modular jack assembly 1 engages with the modular plugs, noise received through the first and second contacts 322, 342 is respectively reduced by the magnetic coils 31, 31' of the front and rear magnetic modules 300, 300'.

It is noted that the second upper pin arrays 304*b*, 304*b'* of the front and rear magnetic modules 300, 300' are connected to the capacitors 360 and the resistors 362 via circuit traces on the third PCB 36. The third plated through hole 366 is defined in the circuit trace of the third PCB 36, and the upper and lower legs 44, 46 of the metal plate 4 function as grounding terminals for respectively soldering with the third PCB 36 and the mother board for providing a grounding path from the third PCB 36 to the mother board. A majority of the upper and lower pins 304, 306 (304', 306') are connected with each other through the magnetic coils 31 (31').

Figure 9:
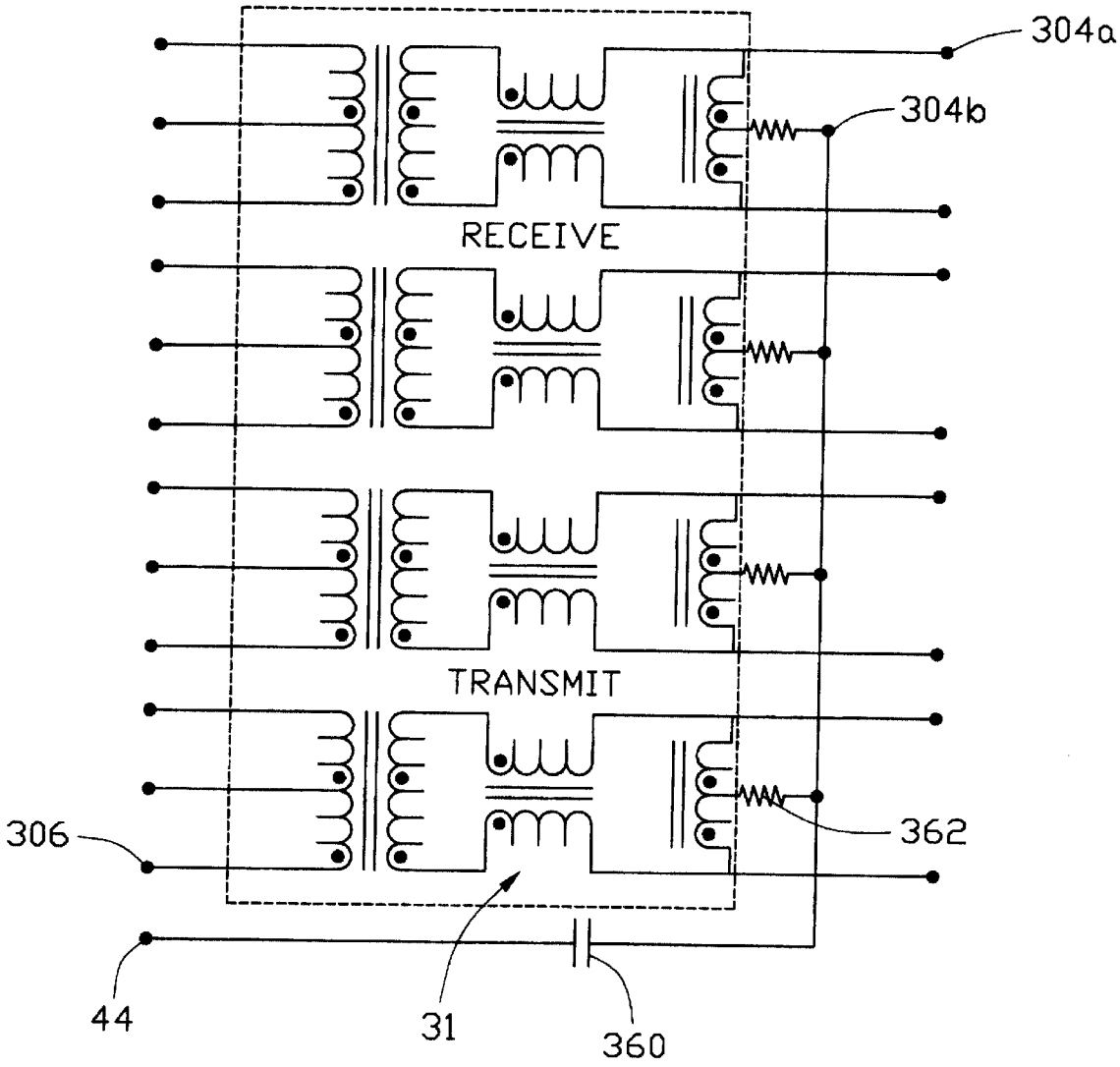
FIG. 9 is a partly schematic diagram of the electrical subassembly circuit of the present invention.

Referring to FIG. 9, it partly shows a schematic diagram of the electrical subassembly circuit of the present invention. This circuit includes magnetic coils 31 for filtering and isolating function, and RC filter circuit comprising resistors (R) 362 and capacitor (C) 360 in both transmit and receive channels. All of these components are included on the magnetic module 300 and the third PCB 36. The circuit of the components on the magnetic module 300' and the third PCB 36 are as identical as that shown in FIG. 9.

Referring to FIGS. 2 and 4, the LED module 6 includes an insulating carrier 60 with leads 68 overmolded therein and a pair of standard LEDs 66 electrically connecting with the leads 68. The carrier 60 has a base portion 62 and a pair of limbs 64 forwardly perpendicularly extending from a top edge of the base portion 60. The leads 68 have legs 680 downwardly extending beneath a bottom edge of the base portion 62 for soldering to the mother board.

Referring to FIG. 8, in assembly, the electrical subassembly 3 is inserted into the housing 2 through the receiving space 23 in the rear face 202. The first and second PCBs 320, 340 of the upper and lower contact array assemblies 32, 34 move forwardly respectively through the upper and lower channels 24, 25 of the housing 2 until the first and second mating portions 3222, 3422 of the first and second contacts 322, 342 respectively extend into the upper and lower receiving cavities 21, 22 through the upper and lower slits 214, 224. During this procedure, the first and second side conductors 325, 345 on the first and second PCBs 320, 340 are received in the corresponding grooves 26 for positioning and guiding the upper and lower contact array assemblies 32, 34. The pair of offsetting projections 48 of the metal plate 4 is received in the offsetting recesses 28 of the housing 2 for positioning the electrical subassembly 3. Therefore, the electrical subassembly 3 is ensured to be accurately inserted into the housing 2. Finally, the serrations on the first and second side conductors 325, 345 of the first and second PCBs 320, 340 have an interferential engagement with the housing 2 in the grooves 26.

The shell 8 then encloses the housing 2 for EMI protection. The LED module 6 is finally secured to the housing 2 in a back-to-front direction. The LEDs 66 are inserted into the upper holes 210 of the housing 2 and can be visible from the front mating face 200. The limbs 64 are received in slots 212 (FIG. 3) defined below the upper holes 210 of the housing 2. The base portion 62 abuts against a rear wall 80 (FIG. 10) of the shell 8 with protrusions 620 (FIG. 2) keying into the housing 2.

It is understood that the magnetic modules 300 (300') of the present invention function as an filter and isolator of the whole circuit, and the arrangement of the obviously separated upper pins 304 (304') and lower pins 306 (306') helps to avoid the functional failure of the magnetic coils 31 (31').

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A modular jack assembly for being mounted on a mother board, comprising:

an insulative housing; and an electrical subassembly assembled to the insulative housing, including:

first and second contact array assemblies; and a pair of magnetic modules each having a container for retaining magnetic coils therein, a plurality of upper and lower pins respectively disposed on upper and lower portions of the container and being coupled to the magnetic coils, wherein some of the upper pins are electrically connected to the corresponding contact array assembly, and the lower pins are electrically connected to the mother board; and wherein the magnetic coils are coupled to the upper and lower pins via a plurality of wires; and wherein the upper and lower pins each forming a right-angled structure attached to the container; and wherein the upper pins are divided into first and second pin arrays; and wherein each contact array assembly includes a printed circuit board (PCB) and a plurality of contacts attached on said PCB, said first pin arrays of the upper pins are electrically connected to the contacts via conductive traces disposed on said PCB.

* * * * *